US006607349B2

(12) United States Patent
Mulera et al.

(10) Patent No.: US 6,607,349 B2
(45) Date of Patent: Aug. 19, 2003

(54) GAS TURBINE ENGINE BROKEN SHAFT DETECTION SYSTEM

(75) Inventors: Tom G. Mulera, Mesa, AZ (US); Dave K Faymon, Phoenix, AZ (US); Kevin A. Jones, Phoenix, AZ (US); Paul M. Stevens, Oro Valley, AZ (US)

(73) Assignee: Honeywell International, Inc., Morristown, NJ (US)

( * ) Notice: Subject to any disclaimer, the term of this patent is extended or adjusted under 35 U.S.C. 154(b) by 18 days.

(21) Appl. No.: 09/992,847

(22) Filed: Nov. 14, 2001

(65) Prior Publication Data

US 2003/0091430 A1 May 15, 2003

(51) Int. Cl.[7] ..... F01D 21/06

(52) U.S. Cl. ..... 415/1; 415/9; 415/14; 415/16; 415/118

(58) Field of Search ..... 415/14, 16, 9, 415/1, 118

(56) References Cited

U.S. PATENT DOCUMENTS

| | | | | |
|---|---|---|---|---|
| 2,930,189 A | | 3/1960 | Petrie | |
| 2,976,012 A | | 3/1961 | Allen | |
| 3,050,939 A | | 8/1962 | Morley | |
| 3,097,824 A | | 7/1963 | Bunger et al. | |
| 3,159,166 A | | 12/1964 | Luedemann et al. | |
| 3,550,108 A | * | 12/1970 | Orlando | 340/671 |
| 3,568,469 A | * | 3/1971 | Wade et al. | 464/160 |
| 3,612,710 A | | 10/1971 | Mount | |
| 4,144,421 A | | 3/1979 | Sakai | |
| 4,737,709 A | | 4/1988 | Loftus | |
| 4,833,405 A | | 5/1989 | Richards et al. | |
| 5,363,317 A | * | 11/1994 | Rice et al. | 364/551.01 |
| 5,411,364 A | | 5/1995 | Aberg et al. | |

* cited by examiner

*Primary Examiner*—Ninh H. Nguyen
(74) *Attorney, Agent, or Firm*—Robert Desmond, Esq.

(57) ABSTRACT

The broken shaft detection system and method uses a detector assembly mounted downstream of a power turbine wheel of a gas turbine engine to detect rearward axial motion of the wheel and thereby a broken shaft event. The detector assembly has a plunger positioned to be axially displaced against a link connected in an electrical circuit. The link may be broken when the plunger is displaced thereby creating an open circuit that may be detected by a detection and test element. The breaking may be communicated to an over-speed circuit that controls a shut off switch that interrupts fuel flow to the engine. The link may be connected to the detection and test element by two pairs of parallels wires to facilitate monitoring of circuit function and to detect failures that are not broken shaft event failures.

17 Claims, 5 Drawing Sheets

GAS TURBINE ENGINE BROKEN SHAFT DETECTION SYSTEM

BACKGROUND OF THE INVENTION

This invention generally relates to systems used to detect failure of gas turbine engines and more specifically to a gas turbine engine shaft failure event. The new detection system uses the physical breaking of an electrical circuit that includes redundant wiring and associated electronics to detect a turbine engine broken shaft.

Gas turbine engines generally include rotating shafts having compressor rotors driven by turbine rotors and other elements attached thereto. The engine shaft in operation rotates at high speed in a turbine having limited tolerance for longitudinal motion of the shaft and its components. If there is an engine failure which allows axial longitudinal motion of the shaft relative to other engine elements the detection of such motion may be used to activate the shut off of the engine thereby minimizing further damage to the engine and preventing turbine overspeed which, for a gas turbine engine such as on an aircraft, may be catastrophic. The shaft breakage may result from bearing failure, imbalance, or other reasons.

Traditionally the failure detection system for gas turbine engine shafts has involved complicated mechanical linkage and hydraulic elements to detect engine failure and cause the shut off of the engine. An example of a single thread electro-optic sensor system is disclosed in U.S. Pat. No. 5,411,364. This sensor system eliminates the need for complicated mechanical mechanisms by use of a single optical communication link that is routed through the stream of gas flow in a sensor element slightly downstream of a rotor element. If a failure or other event causes axial motion of the turbine rotor in the direction of the optical communication link such that a rotor element impacts the sensor, the optical communication link is broken which condition may be detected as the absence of an optical signal. This system requires use of active electro-optical components, such as, light emitting diodes and light activated diodes, near the turbine or use of optical wave-guides and other components for sensing and transmitting. Use of such components in or near the turbine is undesirable as the turbo machinery represents an inhospitable environment for such equipment that may result in sensor failure and false indication of engine failure.

The use of electromechanical switches to detect compressor failure has been disclosed in U.S. Pat. No. 3,612,710. While this invention discloses a primarily mechanical switch with electrical continuity/discontinuity features, it is complex in operation, which may lead to failure of the sensor and false indication of compressor condition. There is no provision to distinguish an open circuit due to the rotor or impeller movement from a failure of the electrical circuit elements. While such lack of differentiation may not be critical for the disclosed compressor application, a false indication for a gas turbine engine such as on an aircraft may be catastrophic.

As can be seen, there is a need for a reliable detection system with a low probability of false indications that is based on a simple mechanism to sense axial motion of a turbine engine rotor shaft.

SUMMARY OF THE INVENTION

An improved gas turbine engine broken shaft detection system according to the present invention comprises a redundant electrical circuit closed by a breakable wire link in communication with detection and control elements for shut off of a gas turbine engine in the event of rotor shaft failure as for example a broken shaft.

In one aspect of the present invention a broken shaft detection system for detecting a gas turbine engine broken shaft comprises a detector assembly having a plunger assembly for axial displacement against a link that forms continuity in a circuit detection element. When the link is broken by axial displacement of the plunger the open circuit created may be detected by a detection and test element that communicates such open circuit to an overspeed circuit. The overspeed circuit controls a shut off switch to actuate a shut off valve to halt fuel flow to the engine. The circuit detection element has two pairs of parallel wires for connection between the link and the detection and test element that enables the system to differentiate between a broken link and a broken wire or wires elsewhere in the interconnections and provides for redundancy and testing of the health of the system.

In another aspect of the invention a method for detection of a broken shaft in a gas turbine engine comprises mounting a detector assembly downstream of a power turbine wheel; positioning a plunger of the detector assembly to be displaced against a link in the event of rearward motion of the power turbine wheel; sensing the breaking of the link; and communicating the breaking to a shut off valve to stop fuel flow to the engine. The detector assembly link may be connected to a detection and test element by two pairs of parallel wires for redundancy and to facilitate testing by measurement of current for open circuit detection; monitoring for current ground paths parallel to the link; and self testing of wires to check open circuits not attributable to the link breaking.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
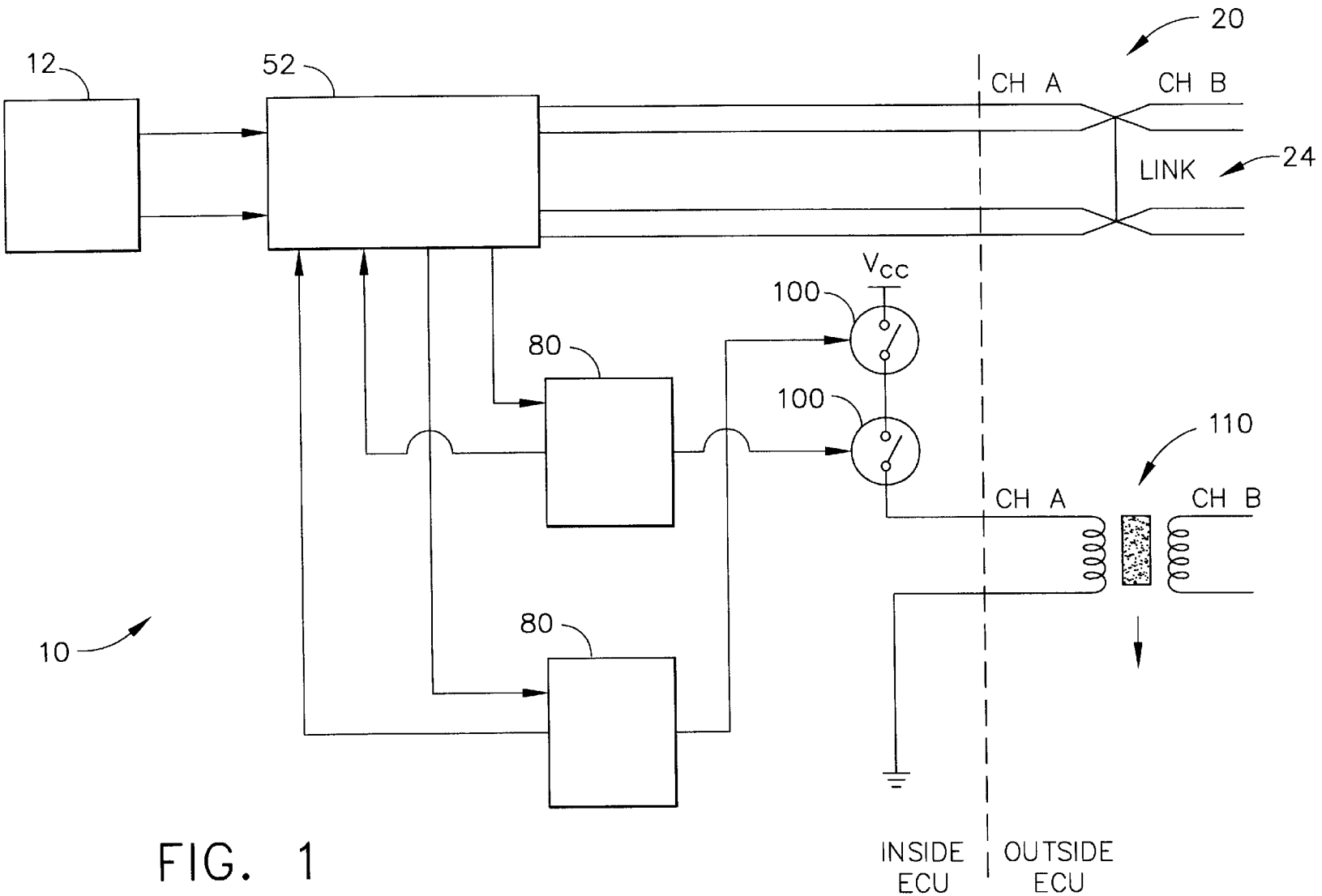
FIG. 1 illustrates a schematic block diagram of the system according to an embodiment of the present invention.

Referring to FIG. 1, a broken shaft detection system 10 may have a closed circuit detection element 20 in communication with dual detection and test elements 52. The detection and test elements 52 may be in communication with output circuits 80 to cause activation of engine shut off switches 100 for activation of the engine shut off valve 110. When a link 24 is broken on the happening of the event of a broken engine shaft, the detection and test elements 52 sense the event and communicate it to the overspeed circuit 80 to initiate shut off of the engine (not shown). A power supply 12 as well as other associated electrical and mechanical support elements, such as, wiring, cables and mounting hardware are associated with the system. The elements represented in FIG. 1 may be located in an electronic control unit or ECU. However, the link 24, interconnecting wiring and the shut off valve 110 may be external to the ECU.

Figure 2:
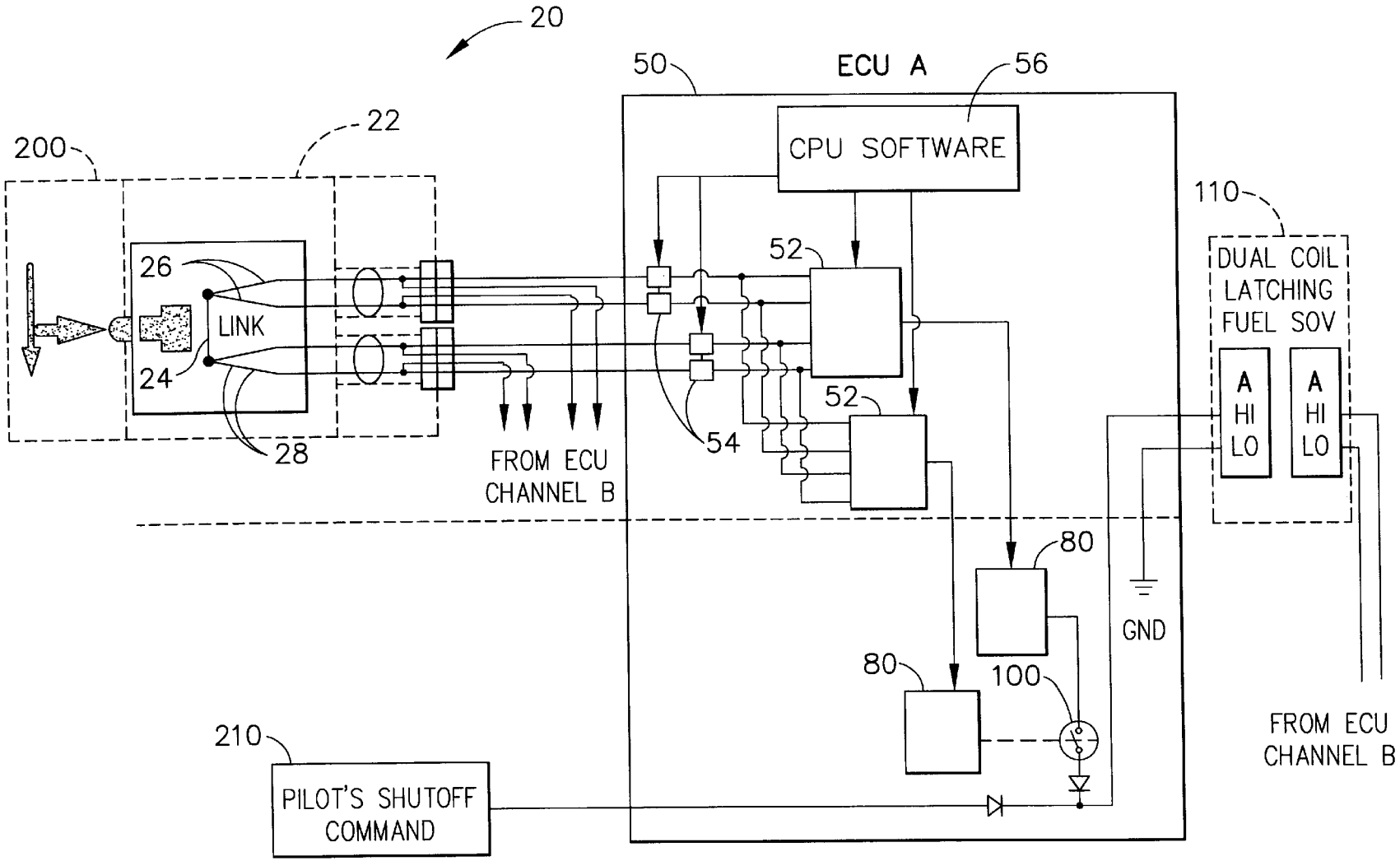
FIG. 2 illustrates a schematic block diagram of the electronic control unit, fuel shutoff valve and detector elements.

Referring to FIG. 2, the ECU 50 is in electrical communication with the circuit detection element 20 and the shut off valve 110. The broken shaft detection system 10 may have in common, elements of a pilot's shutoff system 210 as well as other engine overspeed or failure systems. The circuit detection element 20 may have a detector assembly 22 that includes a link 24 that provides circuit continuity between circuit wire pairs 26, 28. The condition of circuit continuity is monitored by the ECU 50.

The two wire pairs 26, 28 are routed from the detector assembly 22 that may be located in the gas turbine engine 200, to the ECU 50. For redundancy the two wire pairs 26, 28 may be split to be in electrical communication with a second ECU 50 (not shown). In this embodiment the paralleling of the two wire pairs may be initiated in the detector assembly 22 to maximize redundant capability.

The two wire pairs 26, 28 may be routed through opto-isolated switches 54 for open/short built in test (BIT) and then connected to a pair of detection and test elements 52. The detection and test elements 52 provide two independent circuits for redundancy and for prevention of false indication (in the event one of the test elements 52 fails) to monitor the turbine shaft status. The opto-isolated switches 54 are used to simulate an open circuit of the link 24 to check the detection and test element 52. The detection and test element 52 may be in communication with the overspeed circuits 80 to activate the shut off switch 100 to apply power to the shut off valve 110.

In operation each detection and test element 52 may be activated when continuity is established in the circuit detection element 20. When the link 24 is severed or open for approximately 1.0 to 1.5 msec as detected by both detection and test elements and continuity exists in the wire pairs 26, 28, the ECU 50 may actuate the shut off valve 110 to stop fuel flow to the engine 200. The use of wire pairs 26, 28 adds redundancy that does not exist in current failure detection systems to detect false failure indications such as loss of a connector. The detection and test elements 52 will not indicate a broken link if either individual circuit 26 or 28 is not continuous when the continuity between the individual circuits 26 and 28 is broken. Each ECU 50 may monitor the detector assembly 22 for redundancy. Once the broken shaft detection system has detected and open link 24 the output circuits 80 may not reset to allow fuel flow if continuity of link 24 is subsequently detected or if the continuity in either or both individual circuit 26 or 28 is subsequently lost. This safety feature prevents introduction of fuel to the engine 200 when the broken shaft event has lead to subsequent damage to the broken shaft detection system. A central processing unit 56 separate from or included in the ECU 50 may be used to control and monitor operation. Information such as detection and test element 52 status, and BIT activation and results may be processed by the central processing unit 56 software.

The ECU 50 enabling of the shut off valve 110 may be accomplished by the activation of both output circuits 80. The output circuits 80 enable shut off switch 100 that may apply 32 to 45 Vdc to the shut off valve 110 for approximately 25 to 800 msec and then maintain approximately 63 to 90 mA thereafter while the signal is active. The overall reaction time of the broken shaft detection system 10 may be less than 4.5 msec to achieve 95 percent of the shut off valve 110 activation voltage.

In addition to detection of a broken or open link 24 element, the ECU 50 may detect, with the link 24 open or closed, an open circuit in wire pairs 26, 28 or both. A short to ground of less than 500 ohms of a wire in wire pair 26 and wire pair 28 may be detected to identify a current path parallel to the link 24. Such condition may prevent detection of an open link 24. Opto-isolated switches 54 may be used to simulate an open circuit between wire pairs 26 and 28 and an open circuit in any one or more wires in the wire pairs 26, 28.

Figure 3:
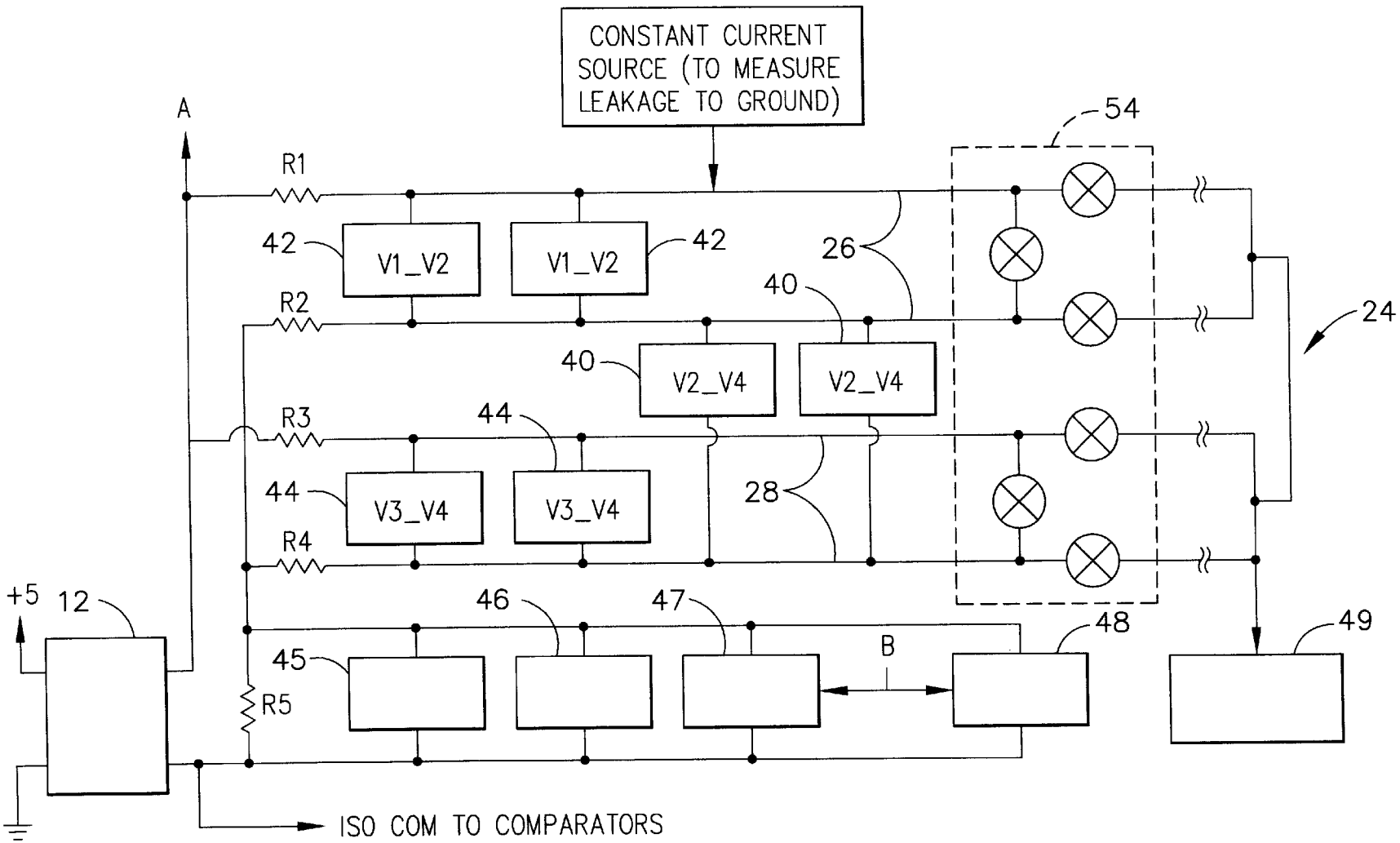
FIG. 3 illustrates a schematic diagram of the detection circuitry for link breakage and system faults.

Referring to FIG. 3, the schematic of elements of the ECU may include dual voltage comparators 40 for detection of a link 24 breakage. Also, the dual voltage comparators 42 and 44 may monitor the wire pairs 26, 28. Under conditions of no fault and no link 24 breakage these comparators 40, 42, 44 sense approximately equal voltage on the wires. The two current monitor elements 45, 46 measure total current flow in the circuit and the two power monitor elements 47, 48 measure voltage level in the circuit. The current leakage element 49 monitors resistance to ground to detect shunt paths that would mask detecting a broken link. The power supply 12 power condition at points A and B is communicated to the detection and test element 52 comparison circuitry. Appropriate valve circuit elements such as resistors R1–R5 are connected for proper circuit parameters.

Figure 4:
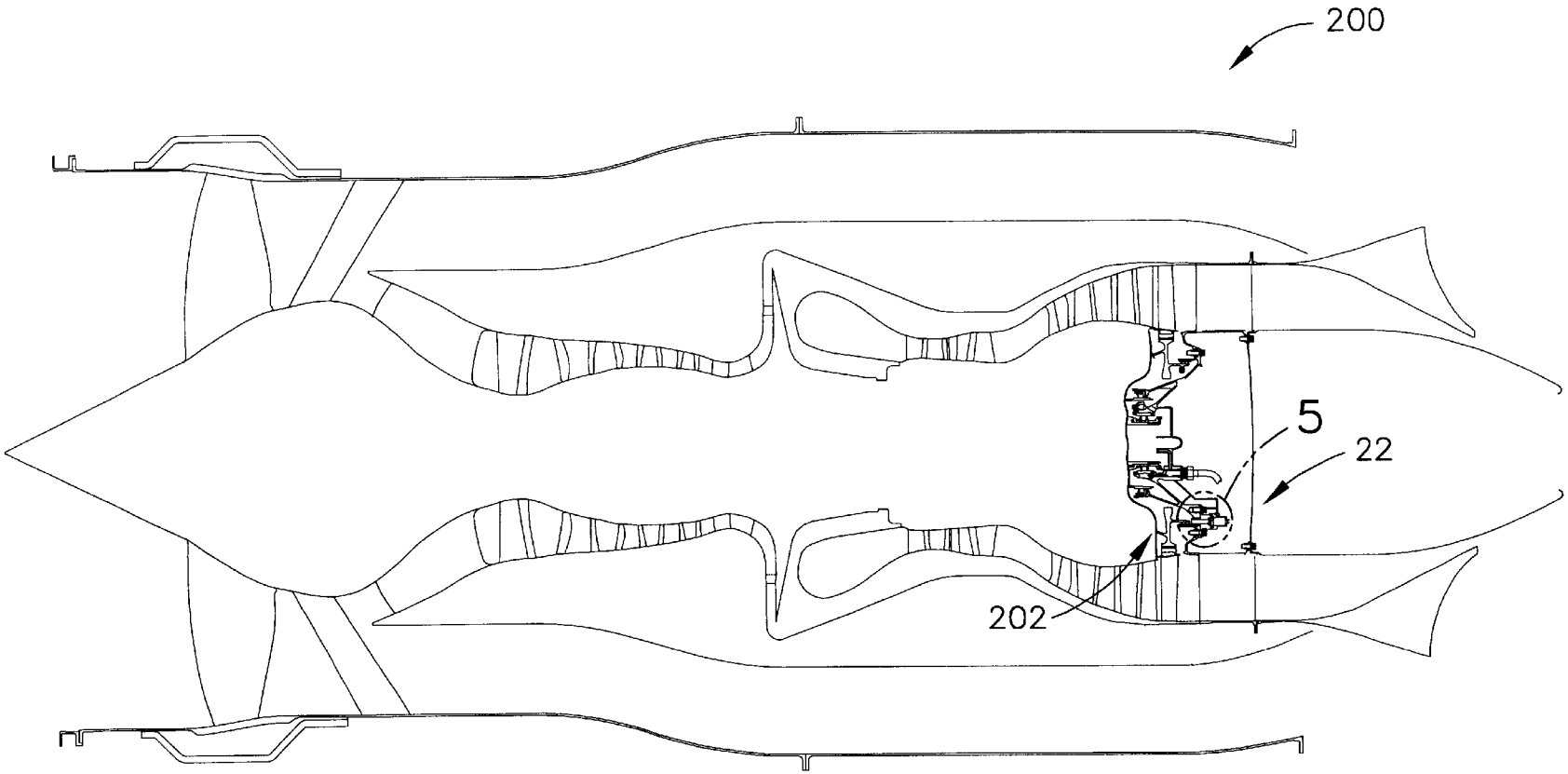
FIG. 4 illustrates an engine mounting location for the detector assembly according to an embodiment of the present invention.
Figure 5:
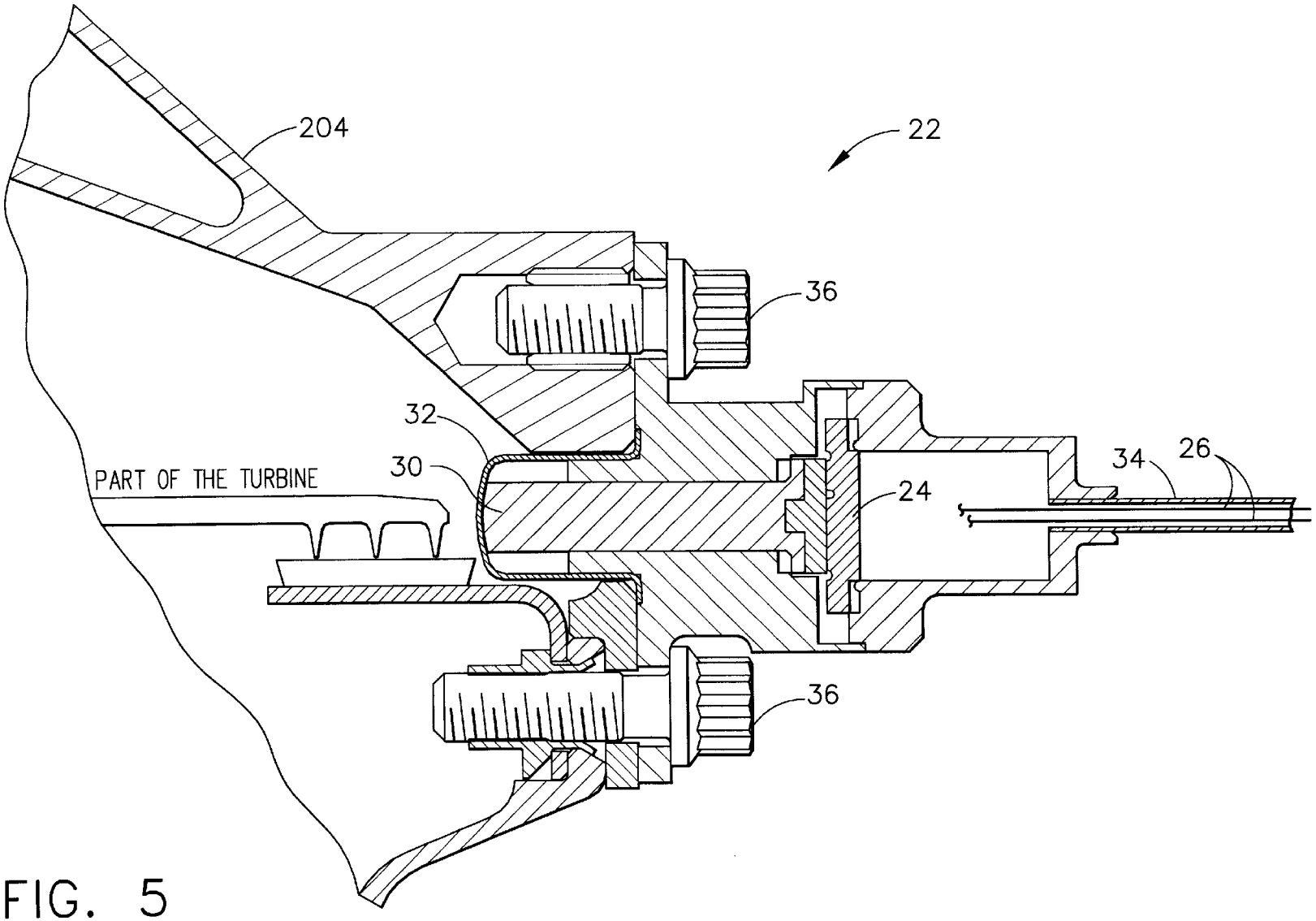
FIG. 5 illustrates a schematic representation of a mounting position for the detector assembly shown in FIG. 4.

Referring to FIGS. 4 and 5, since the engine 200 broken shaft detection system 10 (hidden from view) should shut off the engine fuel supply relatively fast, detection may be set for activation in approximately 1.0 to 1.5 msec, to prevent overspeed of the turbine and catastrophic damage to the engine 200. In addition the broken shaft detection system should be resistant to false indications of shaft failures to avoid aircraft in-flight shut down. In the herein described embodiment, the detector assembly 22 may be mounted behind the stage 3 power turbine wheel 202 to detect power turbine rearward motion associated with a shaft breakage event. The detector assembly 22 may be attached by bolts 36 to the engine near bearing holder 204. A plunger 30 may be positioned behind a plunger cover 32 to minimize exposure to the turbine environment. The plunger 30 may be positioned against the link 24 assembly such that rearward motion of the plunger 30 breaks the link 24 thereby indicating the broken shaft event. The wire pairs 26, 28 (one pair illustrated) may each be carried in connecting tubes 34 to be routed to the ECU 50. The use of a plunger 30 and link 24 allows minimization of components that must be located in the harsh turbine environment as compared to existing systems.

It should be understood, of course, that the foregoing relates to preferred embodiments of the invention and that modifications may be made without departing from the spirit and scope of the invention as set forth in the following claims.

We claim:

1. A system for detecting a broken shaft for use with gas turbine engines to detect axial shaft motion comprising:

a circuit detection element with a detector assembly having a plunger adjacent to a link wherein said plunger may be axially displaced by a force thereby breaking said link;

a detection and test element in electrical communication with said link;

two sets of a pair of parallel wires connecting said link to said detection and test element;

said detection and test element in electrical communication with an overspeed circuit that controls a shut off switch wherein said shut off switch may apply power to activate a shut off valve; and an electric power source in communication with said detection and test element.

2. The system as in claim 1 wherein one set of said two sets of a pair parallel wires is attached at each end of said link.

3. The system as in claim 1 wherein each wire of said pair of parallel wires is routed through an opto-isolated switch and said opto-isolated switches are controlled by a central processing unit.

4. The system as in claim 1 wherein said pair of parallel wires are split to form a second pair of parallel wires that are routed to a second detection and test element.

5. The system as in claim 1 wherein there are two detection and test elements and two overspeed circuits.

6. The system as in claim 1 wherein said detector assembly is mounted in a gas turbine engine downstream of a third stage power turbine wheel attached to a rear bearing holder.

7. The system as in claim 1 wherein said plunger is enclosed in a plunger cover.

8. A system for detecting a broken shaft for use with gas turbine engines to detect axial shaft motion comprising:

a circuit detection element with a detector assembly having a plunger adjacent a link wherein said plunger may be axially displaced by a force thereby breaking said link;

an electronic control unit in electrical communication with said link wherein said electronic control unit comprising a detection and test element connected to said link by two sets of a pair of parallel wires with one set attached at each end of said link; said detection and test element in electrical communication with an output circuit that controls a shut off switch wherein said shut off switch may apply power to activate a shut off valve external to said electronic control unit; and an electric power source in communication with said detection and test element.

9. The system as in claim 8 wherein each wire of said pair of wires is routed through an opto-isolated switch in said electronic control unit and said opto-isolated switches are controlled by a central processing unit.

10. The system as in claim 8 wherein said pair of parallel wires are split to form a second pair of parallel wires that are routed to a second detection and test element.

11. The system as in claim 8 wherein there are two detection and test elements and two overspeed circuits.

12. The system as in claim 8 wherein said detection and test elements comprising a pair of voltage comparators connected between said two sets of said pair of parallel wires, a pair of dual voltage comparators connected between each wire of said pair of parallel wires, a current monitor and power monitor connected to measure current and power levels and a voltage leakage element connected to measure isolation from ground.

13. The system as in claim 8 wherein said detector assembly is mounted in a gas turbine engine downstream of a third stage power turbine wheel attached to a rear bearing holder.

14. The system as in claim 8 wherein said plunger is enclosed in a plunger cover.

15. A system for detecting a broken shaft for use with gas turbine engines to detect axial shaft motion comprising:

a circuit detection element with a detector assembly having a plunger adjacent to a link wherein said plunger may be axially displaced by a force thereby breaking said link;

a detection and test element connected to said link by two sets of a pair of parallel wires with one set attached at each end of said link;

each wire of said pair of parallel wires routed through an opto-isolated switch and said opto-isolated switches are controlled by a central processing unit;

said detection and test element in electrical communication with an overspeed circuit that controls a shut off switch wherein said shut off switch may apply power to activate a shut off valve; and an electric power source in communication with said detection and test element.

16. A method for detecting a broken shaft in a gas turbine engine, comprising the steps of:

mounting a detector assembly downstream of a power turbine wheel of the gas turbine engine;

positioning a plunger of said detector assembly to be axially displaced when said power turbine wheel experiences rearward axial motion;

breaking a link when said plunger is axially displaced in said detector assembly which link is necessary for continuity in a circuit detection element;

sensing the event of breaking of said link in a detection and test element by measuring current to detect an open circuit in two sets of a pair of parallel wires with one set connected to each end of said link;

communicating the event of breaking to an overspeed circuit for activation of a shut off switch; and applying electric power by activation of said shut off switch to a shut off valve to halt fuel flow to the gas turbine engine.

17. The method as in claim 16 for testing thereof, further comprising the steps of:

differentiating between a broken link and a broken wire or wires elsewhere in the interconnection with said detection and test element;

monitoring each one of said pair of parallel wires connected at each end of said link for isolation to ground to identify a current path therebetween in parallel with said link; and activating an opto-isolated switch connected to each wire of each pair of parallel wires to simulate an open circuit between said pairs of parallel wires and an open circuit in any one or more wires.

* * * * *